US005248164A

United States Patent [19]

Lepretre

[11] Patent Number: 5,248,164

[45] Date of Patent: Sep. 28, 1993

[54] STUB BINDING FOR THE FILING OF LOOSE SHEETS AND INTERPOSED SHEETS

[76] Inventor: Joël Lepretre, Résidence le Maxime, Entrée 12, 83120 Sainte Maxime, France

[21] Appl. No.: 869,849

[22] Filed: Apr. 16, 1992

[30] Foreign Application Priority Data

Apr. 26, 1991 [FR] France ..... 91 05545

[51] Int. Cl.[5] ..... B42D 1/08

[52] U.S. Cl. ..... 281/22; 281/28; 281/45

[58] Field of Search ..... 281/2, 3.1, 5, 10, 12, 281/14, 15.1, 21.1, 22, 28, 38, 45, 49, 23

[56] References Cited

U.S. PATENT DOCUMENTS

| | | | |
|---|---|---|---|
| 1,170,793 | 2/1916 | Ballantine | 281/21.1 |
| 1,469,573 | 10/1923 | Aberle . | |
| 2,277,318 | 3/1942 | Grant | 281/22 |
| 2,310,725 | 2/1943 | Widden et al. | 281/22 |
| 2,918,066 | 12/1959 | Carlson | 281/21.1 |
| 4,715,759 | 12/1987 | Larque | 281/23 |
| 4,793,758 | 12/1988 | Hanson et al. | 281/21.1 |
| 4,995,641 | 2/1991 | Landry et al. | 281/15.1 |

FOREIGN PATENT DOCUMENTS

| | | |
|---|---|---|
| 0140197 | 5/1985 | European Pat. Off. . |
| 0150654 | 8/1985 | European Pat. Off. . |
| 0266454 | 5/1988 | European Pat. Off. . |
| 0298709 | 1/1989 | European Pat. Off. . |
| 2318036 | 2/1977 | France . |
| 2409862 | 6/1979 | France . |
| 2543066 | 9/1984 | France . |
| 2554051 | 5/1985 | France . |
| 2557029 | 6/1985 | France . |
| 469946 | 8/1937 | United Kingdom . |

*Primary Examiner*—Mark Rosenbaum
*Assistant Examiner*—Willonm Fridie, Jr.
*Attorney, Agent, or Firm*—Young & Thompson

[57] ABSTRACT

The binding (1) has a stub (2) and, emerging from the stub, one or several filing sheets (3, 4, 5, 6, 7). Each sheet comprises one or two vertical strips (8,9) covered with a pressure-sensitive adhesive layer protected by a protective film. The thickness of the strips (adhesive layer and protective film) is equal to the thickness of a compensation sheet (12) provided between two sheets of the binding (1), so as to permit emplacing an interposed filing sheet. The invention is applicable to filing, particularly of account sheets or the like.

8 Claims, 3 Drawing Sheets

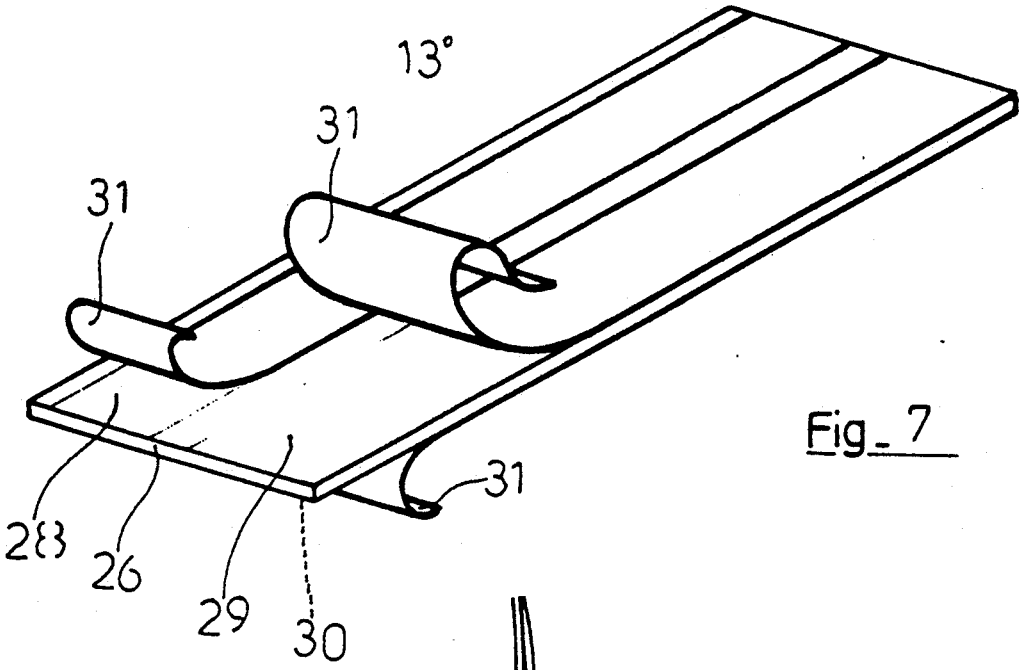
Fig. 7
FIG. 8
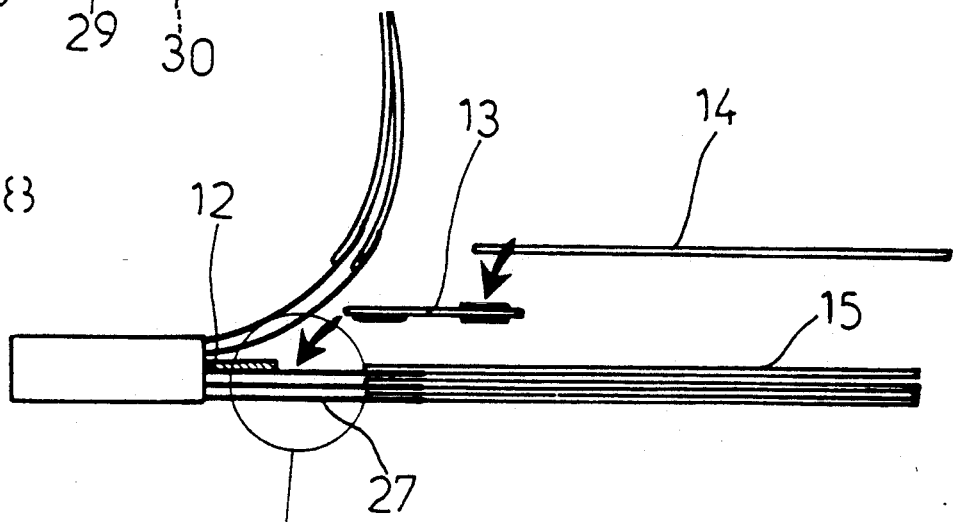
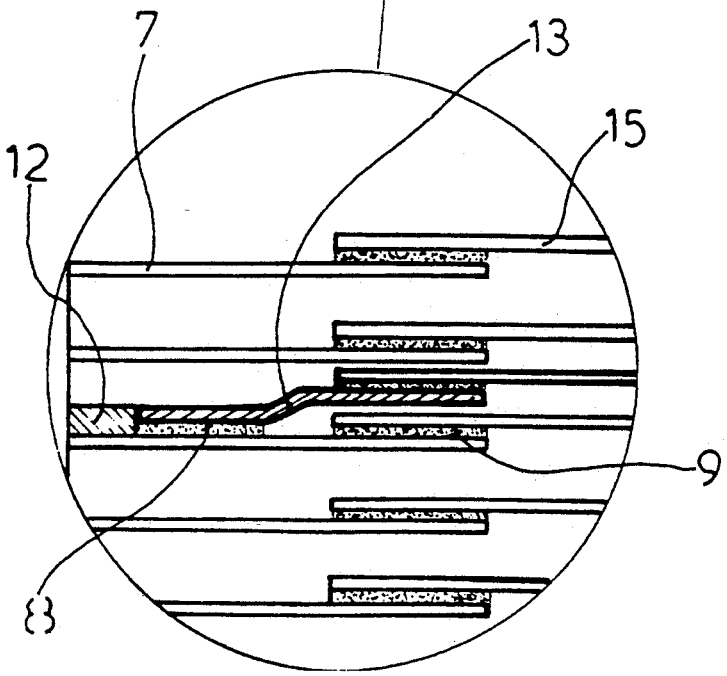
Fig. 9

STUB BINDING FOR THE FILING OF LOOSE SHEETS AND INTERPOSED SHEETS

FIELD OF THE INVENTION

The invention has for its object a stub binding for particularly the filing of loose leaves and interposed leaves.

BACKGROUND OF THE INVENTION

The filing of loose leaves has a number of difficulties. At present, the filing of these loose leaves is effected by perforating the leaves and filing them in a ring binder. The leaves not having the same sizes and not having been punched at the same time, the binder has at its edges leaves which protrude more or less. The leaves, if they are frequently referred to, should be provided with eyelets so that the perforations will not tear the sheets. Finally, to photocopy a sheet, it is necessary to remove it from the rings of the binder, mark the place of the leaf, and return it to that place, thus sometimes removing a bundle of sheets with the difficulty of reintroducing of them by their perforations on the rings of the binder. All these operations are long and laborious.

The state of the art can be defined by the following patents:

FR-A-2.577.029: "The invention relates to devices of the filing and file type for documents and of the book type in one or several embodiments, and consists in a stub with pages of double thickness, a permanent one which is very thin, the other detachable permitting the securement of the documents in their place without swelling the binding. Among the most interesting uses of the invention can be cited: administrative files, provision of book files, according to their construction, filing of scholarly and university articles, private correspondence and the preservation of financial records."

FR-A-2.409.862: "Strip ensuring the connection between a file and the objects to be filed. Device permitting arranging in a file brochures, sketches, specimens and various objects of the same type, without having to perforate them. It is a narrow band, fairly resistant, having along one edge an adhesive portion and along the other edge perforations. The invention facilitates the arrangement and transport in a file of non-perforable objects according to their thickness, their hardness, their fragility, or which one does not wish to punch: brochures, agendas, sketches on cardboard, engravings on metal, etc. . ."

In this patent, the support strip is perforated and must necessarily be filed in a ring binder with all the drawbacks described above.

EP 0 150 654: "The invention relates to a stub binder particularly for the filing of documents in the form of loose leaves, of the type comprising a plurality of thin superposed strips, interconnected by any appropriate means and coated on one of their surfaces with a layer of adhesive, characterized in that all of the adhesive surface is covered with a film in which is provided at least one line of least resistance permitting partial removal of said film so as to substitute at least one portion of the loose leaf to be filed, this latter thus extending in the prolongation of the undetached portion of said film."

This binder does not permit emplacing interpolated leaves. The filing of the sheets is thus final.

EP 0 140 197: "The invention relates to a binding for paper sheets which have a binder back and rear binder covers connected to each side of this latter by means of folds, along which at least the forward binder cover is comprised by a forward tongue connecting by a single piece to the back of the binding and of a synthetic transparent sheet material, secured by means of a layer of cement, to the internal surface of the forward tongue. The binding also has a fusible binding agent carried by the internal surface of the binding back, for the securement of sheets of paper. To effect a securement which is simple to obtain and which guarantees best adhesion of the sheet of transparent synthetic material, the layer of cement is comprised by a fusible cementing agent having an activation temperature, which during emplacement of each of the sheets of synthetic material on the fusible cementing agent thus heated does not undergo any permanent modification, visible to the eye, of the sheet of synthetic material".

FR-A-2.318.036: "This device is constituted by a cover having two sheets of dimensions substantially equal to the dimensions of the sleeves to be bound, secured to a back whose width is substantially equal to the thickness of the stack of sheets. According to the invention, the internal surface of the back is covered with a band of solidified resin of low melting point."

EP-0.298.709: "The invention relates to a filing binder comprising: a section for filing leaves, having a section with a full rear cover, a narrow forward section drawn together by a bridle and a dorsal section disposed between the two. The dorsal section is provided with a vinyl adhesive which melts under heat, preferably in the form of a certain number of very closely spaced beads of cement melting under heat, and the portion attached by the bridle comprises a row of adhesive separable by pressure secured to a free edge of this portion. The cover portion of the file is completely separated from the file and can even be no part of the file. Once the cover is prepared it is attached to the bridle by means of pressure-sensitive adhesives. The pages of the document are stacked and inserted against the strips of cement of the dorsal part and the cement is heated to secure the pages of the document."

EP 0 266 454: "Bindings or improved binding seals are proposed which are comprised by a layer of flexible material. At one end of the layer is located a layer of ordinary adhesive and at the other end a layer of releasable adhesive, covered by a layer of ordinary adhesive. The releasable adhesive permits the user to cement the end of the binding and to release it as desired. The binding can be comprised by a hole or holes at one end for connecting it to a file and provided with a releasable adhesive layer at the other end so that a document can be emplaced and removed."

SUMMARY OF THE INVENTION

To this end, the binding according to the invention is of the stub binding type of which the binding block is comprised by a stub and, emerging from the stub, one or several filing sheets, said sheets comprising one or two vertical strips covered with a layer of pressure-sensitive adhesive protected by a protective film, the thickness of the strips (layer of adhesive and protective film) being equal to the thickness of the compensation sheet provided between two sheets of the binding, so as to permit if desired the emplacement of an interpolated filing sheet.

According to a preferred embodiment, the filing sheet comprises one or two vertical strips on each surface, so as to permit a document to be read on both sides; in this embodiment, the sheet is transparent.

In an embodiment, the stub of the binding is perforated.

In an embodiment, the stub of the binding is provided with one or several adhesive strips.

According to another embodiment, the binding can comprise a removable interpolated sheet; said sheet is in the form of a strip of a width equal to the width of the filing sheet emerging from the stub of the binding. This strip comprises on the back two adhesive strips which correspond to the two vertical strips of the classification sheet on which will be attached the interposed removable sheet; the front of said strip comprises at least one adhesive strip, covered by a protective film which permits the securement and the emplacement of the interpolated sheet to be filed.

BRIEF DESCRIPTION OF THE DRAWINGS

The accompanying drawings are given by way of examples and are not limiting. They show a preferred embodiment according to the invention. They permit easy comprehension of the invention.

FIG. 7 is a perspective view of an interposed filing sheet.

FIG. 8 is a cross sectional view of a binding showing the emplacement of the interposed filing sheet and the interposed document.

FIG. 9 is a view of a detail from FIG. 8.

DETAILED DESCRIPTION OF THE INVENTION

Figure 1:
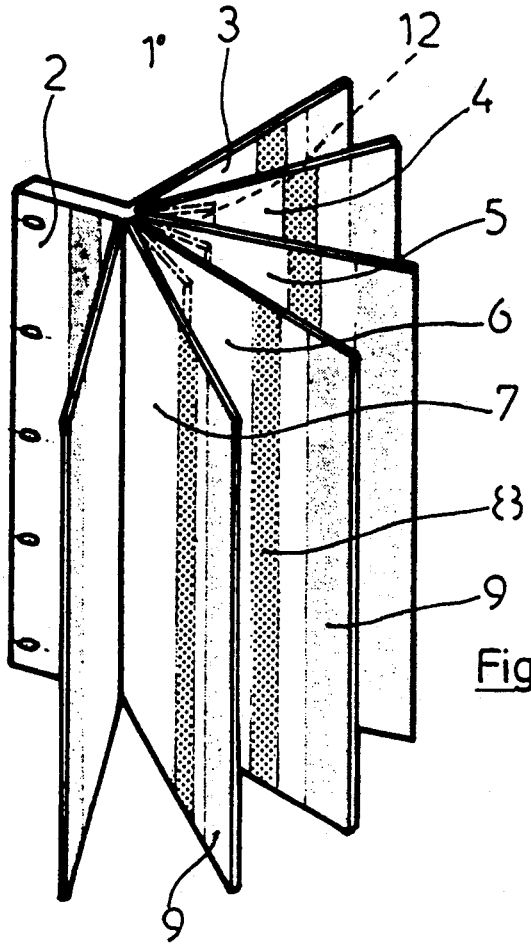
FIG. 1 is a perspective view of a stub binding according to the invention.

The binding 1 according to the invention is of the stub binding type in which the binding is comprised by a stub 2 and, emerging from the stub 2, one or several filing sheets 3, 4, 5, 6 and 7.

The filing sheet 3, 4, 5, 6 or 7 comprises one or two vertical strips 8, 9 covered with a layer of pressure-sensitive adhesive 10 protected by a protection film 11.

The thickness of the vertical strips 8, 9 is equal to the thickness of the compensation sheet 12 provided between the two sheets 3, 4, 5, 6 or 7 of the binding 1, so as to emplace if desired an interposed filing sheet 13, for the filing of a document 14 interposed between other documents 15, already filed.

To file a document 16, it suffices to take off the protective film 11 from the vertical strip 9 to permit then emplacing, by simple pressure on the vertical strip 9 of adhesive 10, the document 16 to be filed.

Figure 2:
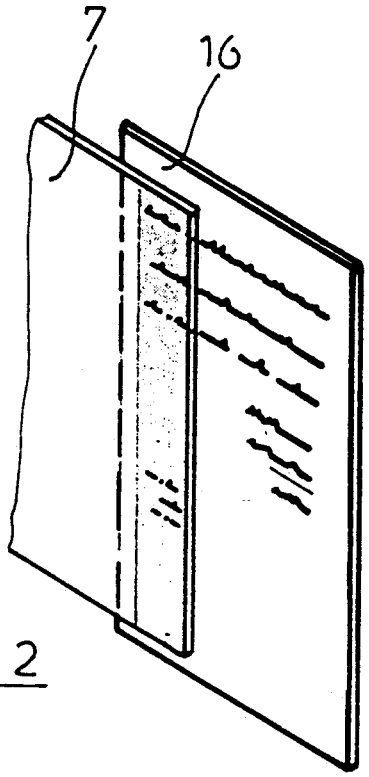
FIG. 2 is a persecutive view of a filing sheet of the binding, which can be transparent, with a document located on the back of said sheet.
Figure 3:
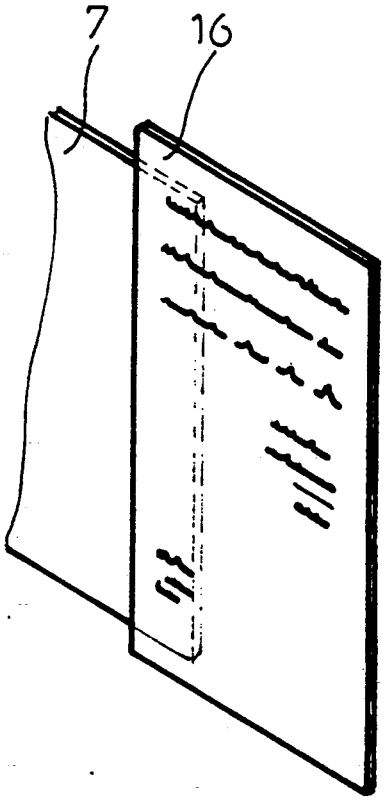
FIG. 3 is a perspective view of a filing sheet of the binder, which can be transparent, with a document located on the front of said sheet.
Figure 4:
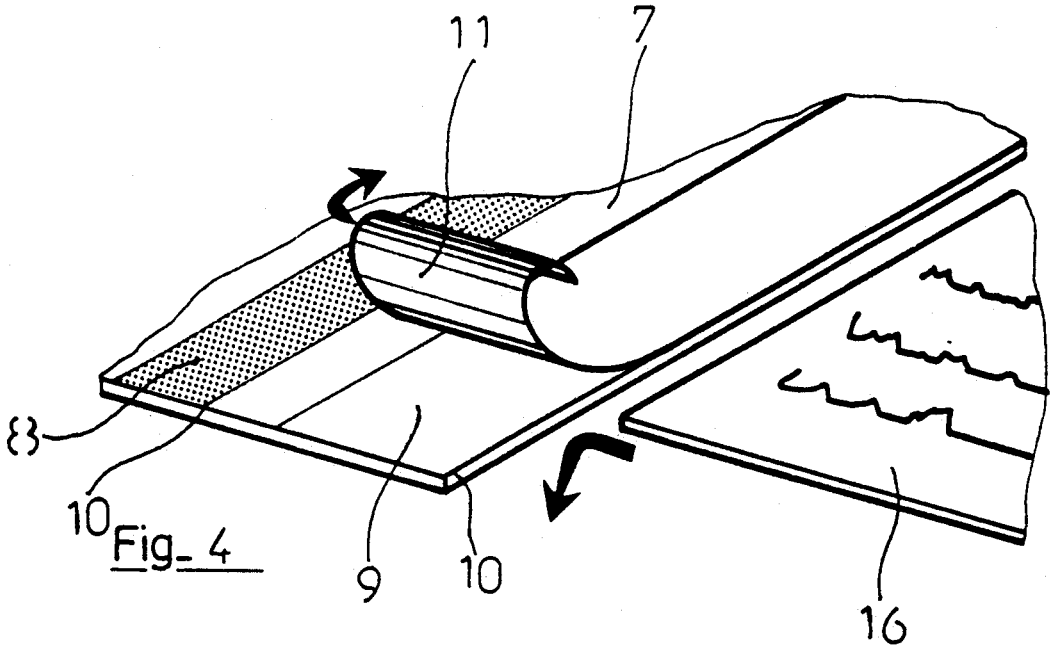
FIG. 4 is a perspective view of a filing sheet with a protective film which is in the course of being removed to expose an adhesive strip which permits the emplacement of a document.

According to an embodiment shown in FIGS. 2 and 3, the filing sheet 7 comprises one or two vertical adhesive strips 9 on each surface, so as to permit front and back filing. In the embodiment shown in FIG. 2, the filing sheet 7 is transparent. In the embodiment shown in FIG. 2, the document 16 is located on the back of the filing sheet 7. In the embodiment shown in FIG. 3, the document 16 is located on the front of filing sheet 7 of binding 1.

In the embodiment shown in FIG. 1, the binding 1 is perforated.

Figure 5:
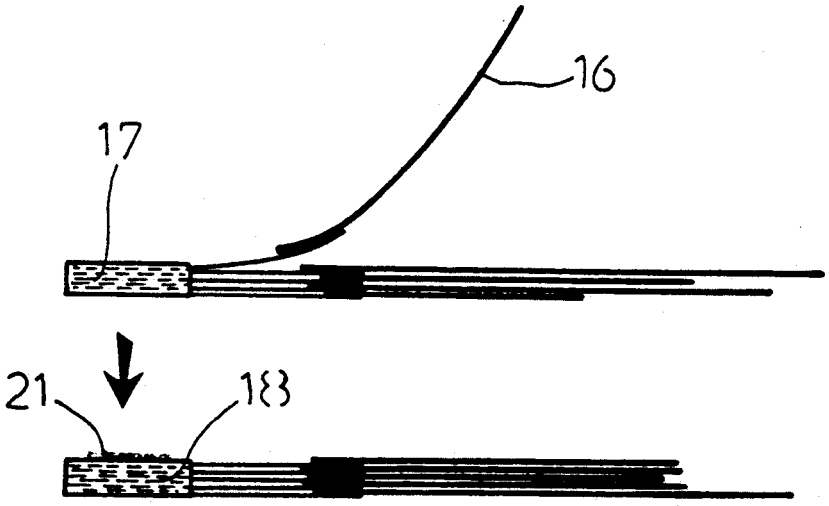
FIG. 5 is a schematic view in cross section of a stub binding according to the invention and in which several stub bindings can be associated one on the other.
Figure 6:
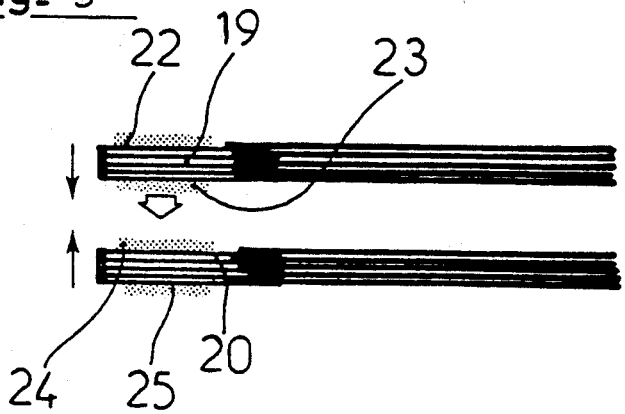
FIG. 6 is a view like FIG. 5 in which is shown the assembly of several stub bindings.

In the embodiments shown in FIGS. 5 and 6, the bindings 17, 18, 19 and 20 are not perforated but are provided with adhesive strips 21, 22, 23, 24 and 25.

The binding 1 can comprise one or several interposed filing sheets 13 to position a document 14, interposed between other documents 15 already filed.

The interposed removable filing sheet is in the form of a vertical strip 26 which is disposed between two filing sheets 6, 7. This strip 26 has a width which is equal to the width of the portion 27 of the filing sheet 7 emerging from the stub of binding 1. The vertical strip 26 comprises on the back two adhesive strips 28, 29 which correspond to the two vertical adhesive strips 8, 9 of the filing sheet 7, on which will be secured the removable interposed sheet 13.

On the font of the strip 26, another adhesive strip 30 permits securing the interposed document 14 to be filed between two documents 15 already filed.

The front and back adhesive strips 30 and respectively 28, 29 are protected by a protection film 31.

REFERENCES

1. Binding
2. Stub
3, 4, 5, 6, 7. Filing sheets
8, 9. Vertical strips
10. Adhesive layer
11. Protective film
12. Compensation sheet
13. Outer interpolated sheet
14. Interpolated document
15. Filed documents
16. Document located on the back of sheet 7
17, 18, 19, 20. Bindings
21, 22, 23, 24, 25. Adhesive strips
26. Vertical strip
27. Part of the filing sheet
28, 29. Adhesive strips
30. Other adhesive strip
31. Protective film

What is claimed is:

1. A binding comprising a stub, several filing sheets emerging from said stub, and a compensation sheet positioned between two filing sheets, wherein each filing sheet comprises at least one vertical strip covered by a layer of pressure-sensitive adhesive protected by a protection film, and each compensation sheet has a thickness equal to the thickness of a vertical strip, so as to permit emplacing an interposed filing sheet, for the filing of an interposed document between other documents already filed.

2. The binding according to claim 1, wherein each filing sheet comprises at least one adhesive vertical strip on each side so as to permit front and back filing.

3. The binding according to claim 2, wherein each filing sheet is transparent.

4. The binding according to claim 1, further including perforations, so as to enable insertion of said binding into a ring binder.

5. The binding according to claim 1, further including adhesive strips thereon.

6. The binding according to claim 1, further comprising at least one removable interposed filing sheet for the positioning of a document interposed between other documents already filed; said removable interposed filing sheet being present in the form of a vertical strip which is disposed between two filing sheets; this strip having a width which is equal to the width of the portion of the filing sheet emerging from the stub of the binding.

7. The binding according to claim 6, wherein the vertical strip forming the removable interposed filing sheet comprises on its back two adhesive strips which correspond to two vertical adhesive strips of a filing sheet for securing said removable interposed sheet, and on its front another adhesive strip for securing the interposed document to be filed between two documents already filed.

8. The binding according to claim 7, wherein the adhesive strips on the front and on the back of the vertical strip forming the interposed filing sheet are protected by a protective film.

* * * * *